US005630652A

United States Patent [19]

Cech

[11] Patent Number: 5,630,652

[45] Date of Patent: May 20, 1997

[54] RELEASABLE AXLE ASSEMBLY FOR SKATE WHEELS

[75] Inventor: Donald E. Cech, Longmont, Colo.

[73] Assignee: Dietrick Sports Products, Inc., Steamboat Springs, Colo.

[21] Appl. No.: 496,129

[22] Filed: Jun. 27, 1995

[51] Int. Cl.[6] ..... B62K 25/02

[52] U.S. Cl. ..... 301/5.3; 301/124.2

[58] Field of Search ..... 301/5.3, 5.7, 111, 301/114, 124.2; 280/11.19, 11.22, 11.23, 11.27

[56] References Cited

U.S. PATENT DOCUMENTS

| | | | |
|---|---|---|---|
| 4,033,627 | 7/1977 | Morroni | 301/124.2 |
| 4,079,958 | 3/1978 | Segawa . | |
| 4,400,038 | 8/1983 | Hosokawa . | |
| 4,666,168 | 5/1987 | Hamill et al. . | |
| 4,763,957 | 8/1988 | Poehlmann et al. . | |
| 4,789,206 | 12/1988 | Ozaki . | |
| 4,906,053 | 3/1990 | Kawai | 301/111 X |
| 5,190,301 | 3/1993 | Malewicz . | |
| 5,277,437 | 1/1994 | Moats . | |
| 5,348,321 | 9/1994 | Sbrilli . | |
| 5,374,072 | 12/1994 | Landers | 301/111 X |
| 5,441,286 | 8/1995 | Pozzobon | 301/5.3 X |

*Primary Examiner*—Russell D. Stormer
*Attorney, Agent, or Firm*—Harold A. Burdick

[57] ABSTRACT

A releasable axle assembly for skate wheels is disclosed, the assembly including an axle, a nut threadable on one end of the axle, a pivotable retainer connected on the other end of the axle, and a stop/washer on the axle adjacent to the retainer. The retainer includes a camming lever movable between securing and relaxed positions against the stop/washer. The lever is manipulated by an actuator/cap that is pivotably connected to the lever.

18 Claims, 5 Drawing Sheets

54
70
74
76
58
72
D
E
F
62
56
66
64
68
52
60
76
54
58
61
48
50
24
32
22
30
116
110
16
80
12
78
78
26
114
18
28
112

RELEASABLE AXLE ASSEMBLY FOR SKATE WHEELS

FIELD OF THE INVENTION

This invention relates to skate wheel axles, and, more particularly, relates to skate wheel axle securing assemblies.

BACKGROUND OF THE INVENTION

Roller skates and in-line skates may utilize different types of wheels depending upon a variety of conditions or preferences (wheel damage, skating surface type, ambient temperature, nature of use and skater preferences, for example). It is thus necessary for a skater to be able to change wheels on a skate to meet conditions if so desired by the skater.

Often, however, a wheel change is needed while skating or when tools (wrenches or the like) usually necessary to perform a skate wheel change are otherwise unavailable. Moreover, the requirement that tools be utilized to change skate wheels is undesirable generally, considering that many skaters are young or otherwise unfamiliar with manipulation of such tools and the skate hardware typically employed to secure (or release) an axle in a skate truck.

While various arrangements have been suggested and/or utilized for releasing wheels from a skate (often called "quick-release" or "quick-change" devices), such arrangements have not been met with wide acceptance and/or have not eliminated the need for tools to accomplish a wheel change (see, for example, U.S. Pat. Nos. 5,348,321, 5,277,437, 4,666,168, and 5,190,301). Further improvement could thus be utilized.

SUMMARY OF THE INVENTION

This invention provides an easily releasable axle assembly for skate wheels that is particularly well adapted for in-line skates. The axle assembly is attractive, durable, reliable, and can be removed from a skate and reassembled on the skate without use of tools, thus allowing on-site wheel changes.

The axle assembly includes an axle having first and second end portions, a first retainer (a nut) engagable at the first end portion of the axle, and a second retainer pivotably connected with the second end portion of the axle and having first surface. A stop is positioned at the second end portion of the axle adjacent to the second retainer, the first surface of the second retainer bearing against the stop when the second retainer is pivoted to a securing position. The second retainer has an actuator/cap pivotably connected thereto for manipulation and protective covering of the second retainer.

The axle is slidably receivable through openings in the truck of the skate. The nut includes a friction face for abutting the truck when the axle is received through the openings in the truck and the nut is engaged on the first end portion of the axle. The second retainer is of a size larger than the openings in the truck and is pivotable between a securing position inhibiting axle rotation when the axle is received through the openings in the truck and the nut is engaged at the first end portion of the axle and a relaxed position enabling such axle rotation.

It is therefore an object of this invention to provide an improved axle assembly for skate wheels.

It is another object of this invention to provide a releasable axle assembly for in-line skates.

It is another object of this invention to provide an axle assembly for skate wheels that can be removed from, and reassembled on, the skate truck without use of tools.

It is still another object of this invention to provide a durable, attractive and reliable axle assembly for skates that is easily releasable from a skate to allow on-site wheel change.

It is yet another object of this invention to provide a skate wheel axle assembly including an axle having first and second end portions, a first retainer engagable at the first end portion of the axle, a second retainer pivotably connected with the second end portion of the axle and having first surface, and a stop on the second end portion of the axle adjacent to the second retainer, the first surface of the second retainer bearing against the stop when the second retainer is pivoted to a securing position.

It is still another object of this invention to provide a releasable axle assembly for skate wheels including an axle having first and second end portions, a first retainer engagable at the first end portion of the axle, a second retainer pivotably connected with the second end portion of the axle, and manipulating means pivotably connected with the second retainer for movement of the second retainer.

It is yet another object of this invention to provide a manually releasable axle assembly for a skate wheel associated with an in-line skate having a truck with openings for receipt therethrough of an axle, the axle assembly including an axle having first and second end portions and slidably receivable through the openings in the truck, a nut threadably engagable at the first end portion of the axle and having a friction face for abutting the truck when the axle is received through the openings in the truck and the nut is engaged on the first end portion of the axle, and a retainer pivotably secured at one side thereof to the second end portion of the axle and being of a size larger than the openings in the truck, the retainer pivotable between a securing position inhibiting axle rotation when the axle is received through the openings in the truck and the nut is engaged at the first end portion of the axle and a relaxed position enabling such axle rotation.

With these and other objects in view, which will become apparent to one skilled in the art as the description proceeds, this invention resides in the novel construction, combination and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
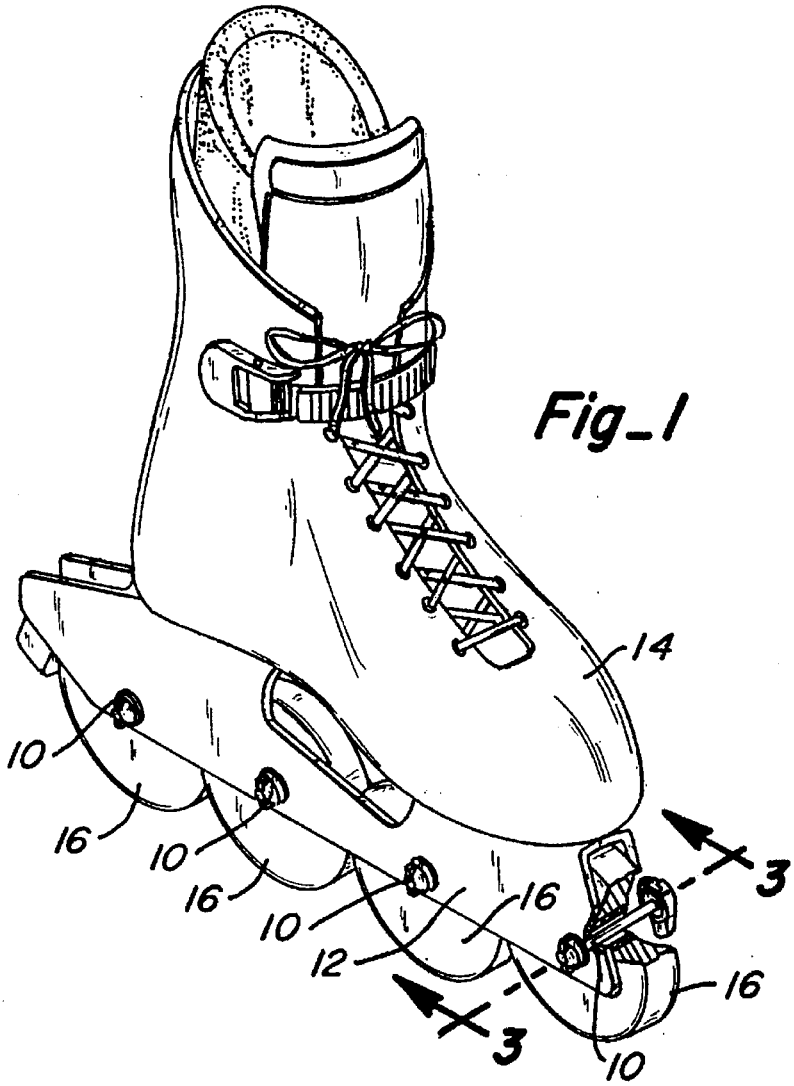
FIG. 1 is a perspective view of an in-line skate with a portion cut away to show the axle assembly of this invention.
Figure 5:
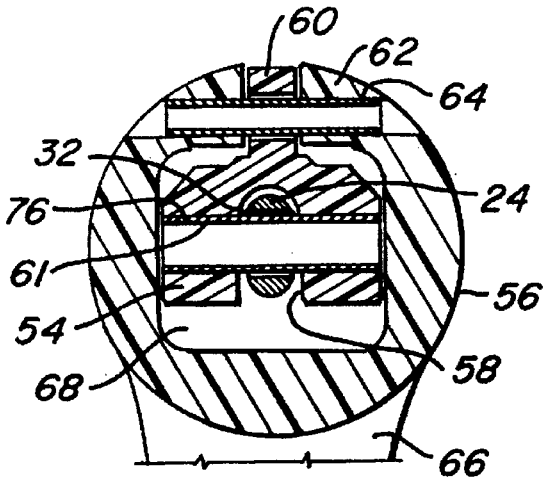
FIG. 5 is a sectional view taken through section lines 5—5 of FIG. 3.
Figure 2:
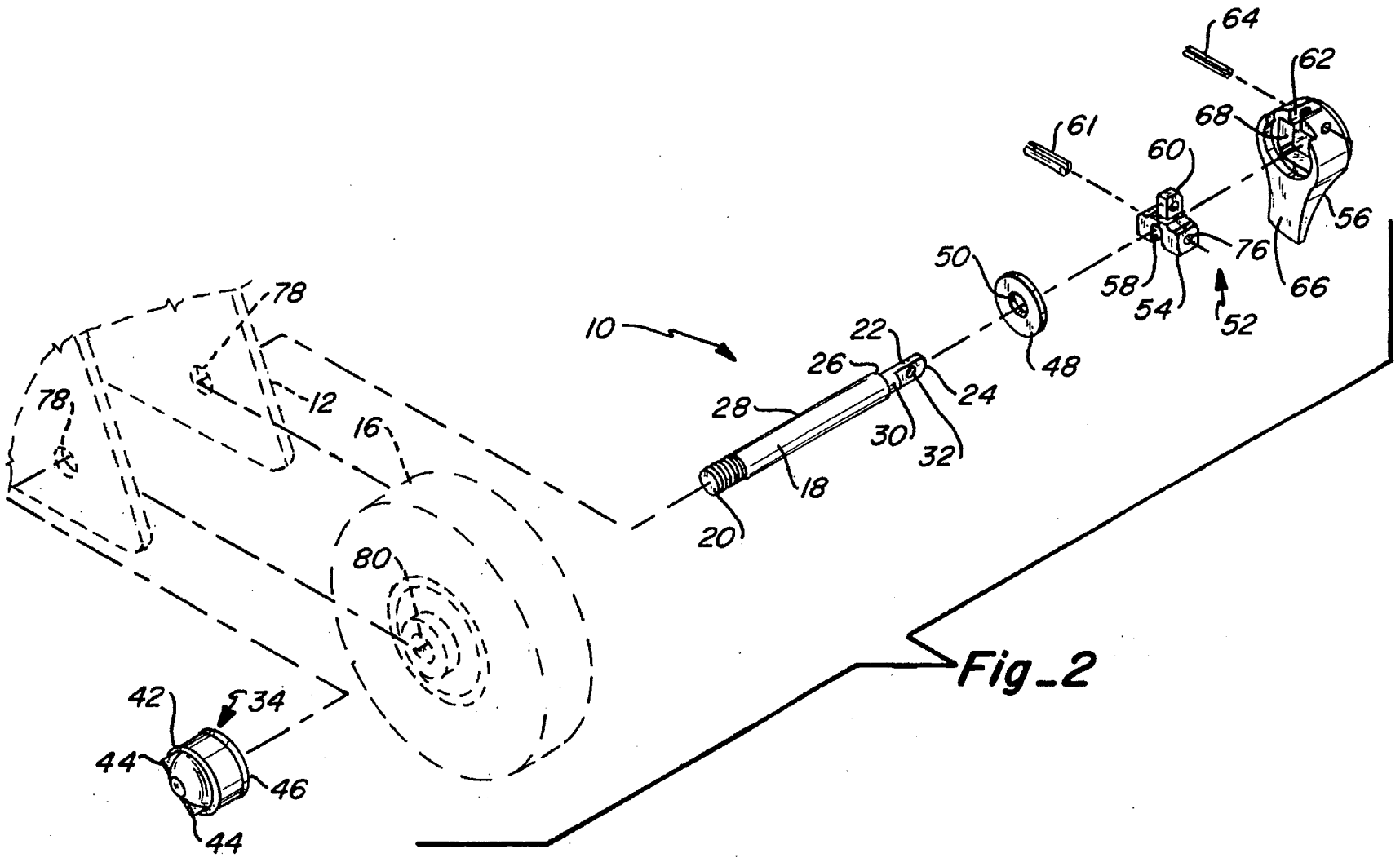
FIG. 2 is an exploded view of the axle assembly of FIG. 1.

Axle assembly 10 of this invention is shown in FIG. 1 mounted in truck 12 of in-line skate 14 (this invention may be utilized with most other types of skates known in the art). Axle assembly 10 has conventional skate wheels 16 mounted thereon.

As is shown in FIGS. 2 through 5, axle assembly 10 includes axle 18 having threaded end portion 20 and tongue 22 configured (machined, molded, cast or the like depending on axle material) at end portion 24. End portion 24 includes abutment 26 between larger diameter axle body 28 and smaller diameter stop mount 30 from which tongue 22 extends. Pivot connection 32 (a bore, for example) is formed at tongue 22.

Figure 3:
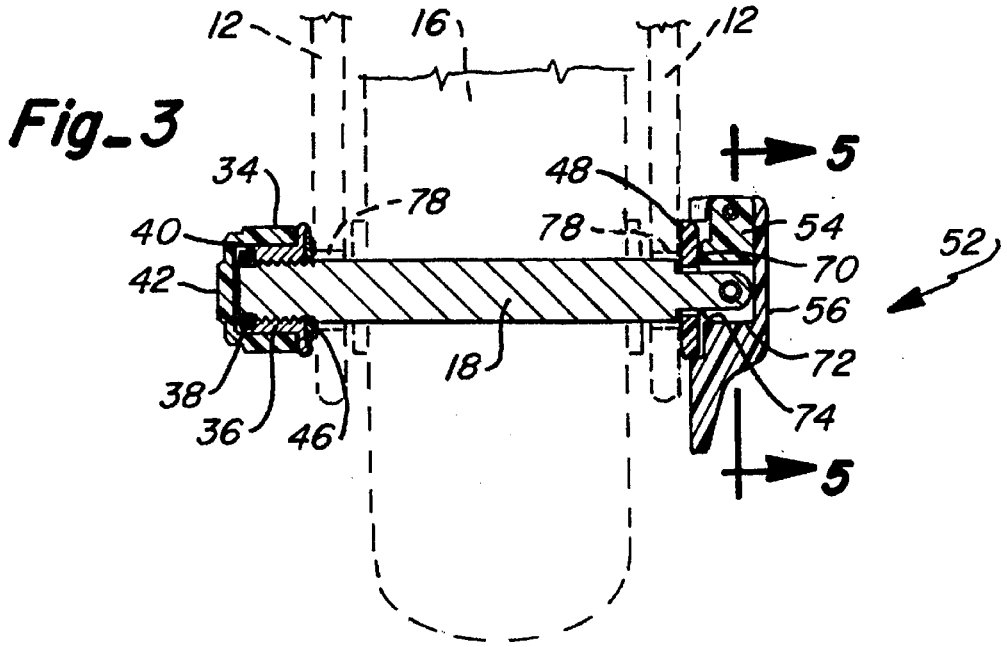
FIG. 3 is a sectional view taken through section lines 3—3 of FIG. 1.

Retainer nut 34 is threadably receivable at threaded end portion 20 of axle 18. Removal of nut 34 is the means by which axle 18 is removed from truck 12. As seen in FIG. 3, nut 34 includes threaded flange nut body 36, O-ring 38 inserted into machined cavity 40 of nut body 36, and cap 42 maintained over nut body 36 (for example, molded onto the nut body in the case of a plastic material cap). Cap 42 is configured with gripping wings 44 at the outer face thereof to facilitate manual manipulating of nut 34. Serrated face 46 of nut body 36 provides a friction locking face for inhibiting nut movement when the nut is secured on axle 18 with face 46 abutting truck 12 of skate 14 (i.e., the serrated locking face provides additional securement against inadvertent loosening while skating).

Stop/washer 48 is mounted over stop mount 30 of axle end portion 24 on center bore 50 (while stop 48 is preferred, one could omit the stop, utilizing the outer wall of truck 12 as the stop with appropriate sizing of the remainder of the components). Stop/washer 48 is retained on mount 30 between axle abutment 26 and pivotable retainer 52, and is free to move axially with respect to mount 30 under some circumstances as set forth hereinafter (see FIG. 4).

Pivotable retainer 52 includes camming lever 54 and actuator/cap (or cover) 56. Lever 54 includes spaced, substantially parallel pivot connections 58 and 60 (a bored yoke and tongue, respectively, though it is to be realized that all yokes and tongues referenced herein could be interchanged on their respective component and/or that other pivot connections could be utilized). The pivot connections are oriented along rotational axes that are substantially perpendicular to axle 18. Pivot connection 58 receives tongue 22 of axle 18 for pivotable movement therebetween utilizing pivot pin 61 through their respective bores. Actuator/cap 56 includes a pivot connection 62 (a yoke) for pivotable connection to connection 60 of lever 54 utilizing pivot pin 64 through their respective bores.

Actuator/cap 56 is structured both for actuation and manipulation of lever 54 and axle 18 using appendage 66 and for covering lever 54 when the assembly is in the secured position as shown in FIG. 3, lever 54 in such case locating in cavity 68 of actuator/cap 56.

Axle 18, nut body 36 and pins 61 and 64 are preferably made of aluminum, steel or stainless steel. All other parts are preferably made of plastic material suitable for the purpose.

Figure 4:
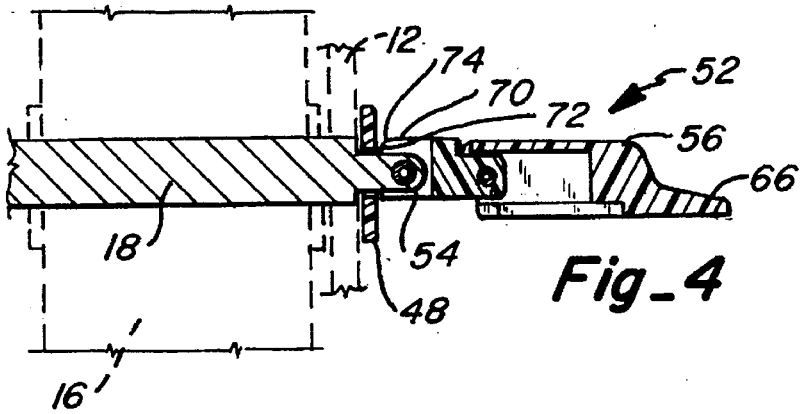
FIG. 4 is a partial sectional view illustrating (in a relaxed position) a pivotable retainer mechanism at one end of an axle of the assembly.
Figures 6, 9:
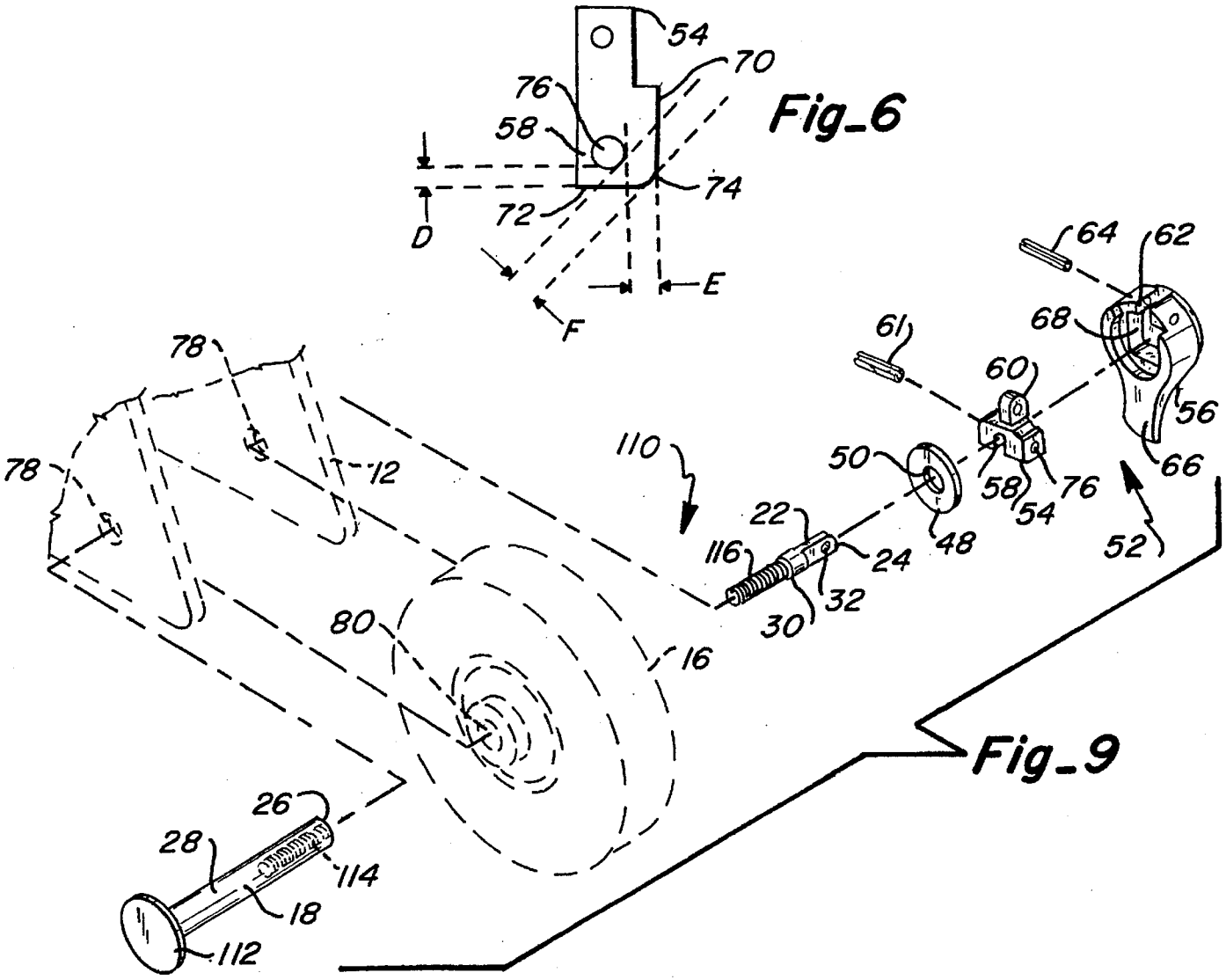
FIG. 6 is a schematic illustration of key dimensions of a camming lever of the retainer mechanism.
FIG. 9 is an exploded view of a second embodiment of the axle assembly of this invention.

As best shown in FIGS. 3, 4 and 6 camming lever 54 includes first bearing surface 70, second bearing surface 72 and intermediate curved surface portion 74, each of which, at different phases of pivoting movement of lever 54, are adjacent to and/or in contact with stop/washer 48. The relative position of these surfaces in relation to the arc of bore 76 through yoke 58 nearest each of the surfaces is important to the safety and function of this invention.

Dimension D is smaller (in the preferred embodiment by about 0.015") than dimension E (which in the preferred embodiment is about 0.073"). Dimension F is larger than dimension E (in the preferred embodiment by about 0.010"). It is also important that the radius defining curved surface portion 74 not meet the center point (i.e., the axis of pivotal movement) of bore 76. This allows camming lever 54 to snap firmly into place, as hereinafter discussed, and to be thus retained in the secured position while skating.

After axle 18 is slid through openings 78 of truck 12 and through axle bore 80 in wheel 16 (see FIGS. 2 and 3), nut 34 is tightened by hand until surface 72 of camming lever 54 is against stop/washer 48. As cam lever 54 is pivoted, curved surface portion 74 creates pressure against stop 48 drawing the assembly tight in truck 12. Further rotation of cam lever 54 forces the cam lever to snap into place with surface 70 firmly pressed against stop 48 thus securing the assembly and locking lever 54 in place.

Figure 7B:
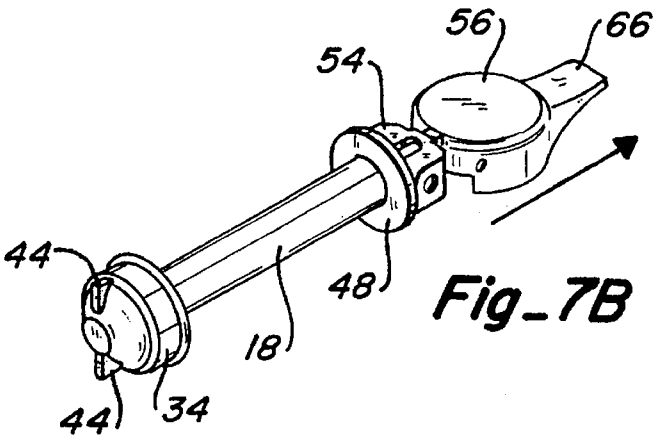
FIGS. 7A through 7C are perspective views of the axle assembly of this invention illustrating axle release steps.
Figure 7A:
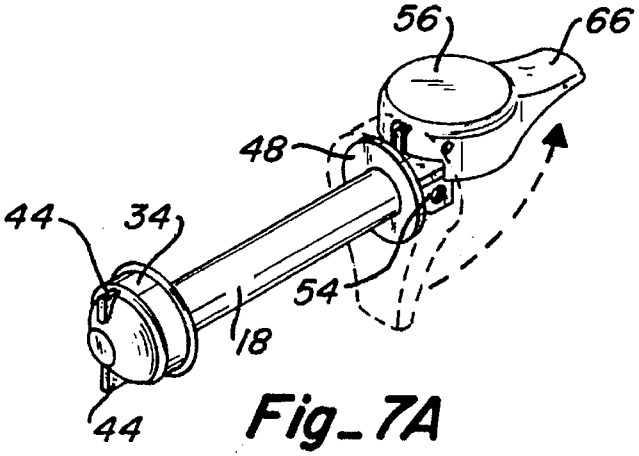
Figure 7C:
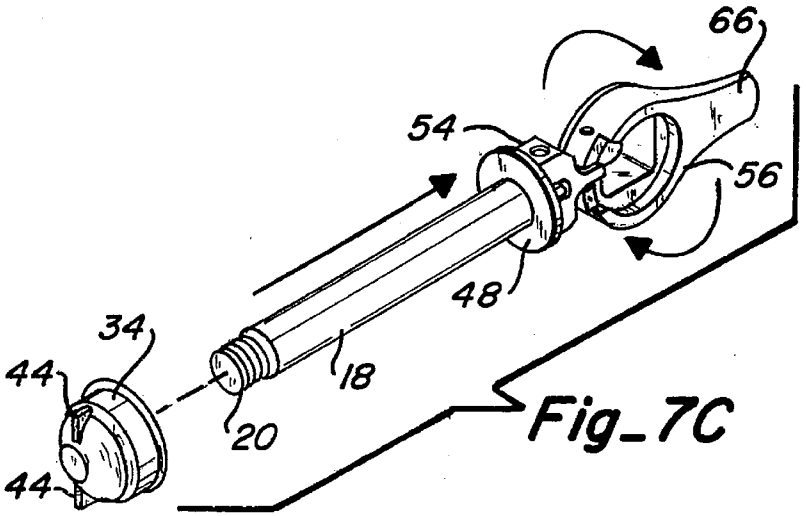

To remove the axle assembly from a skate, actuator/cap 56 is lifted at appendage 66 (FIG. 7A), a firm pull on actuator/cap 56 causing lever 54 to pivot to a relaxed position with surface 72 adjacent to stop 48 (FIG. 7B). Using appendage 66, axle 18 is turned to loosen the axle from nut 34 (FIG. 7C), friction face 46 of nut 34 holding the nut motionless for at least a part of a turn. The nut may then be removed and the axle slid from truck and wheel openings 78 and 80, respectively.

Figure 8B:
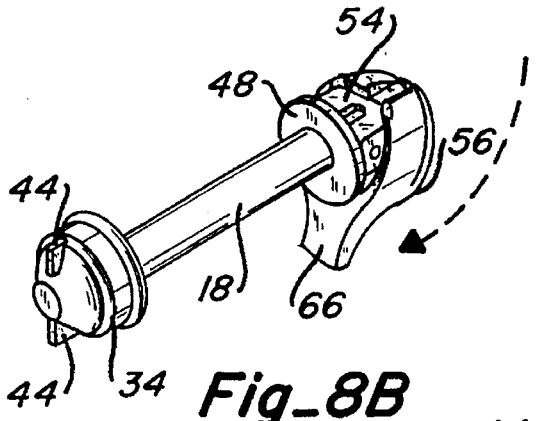
FIGS. 8A through 8C are perspective views of the axle assembly of this invention illustrating axle reassembly steps.
Figure 8C:
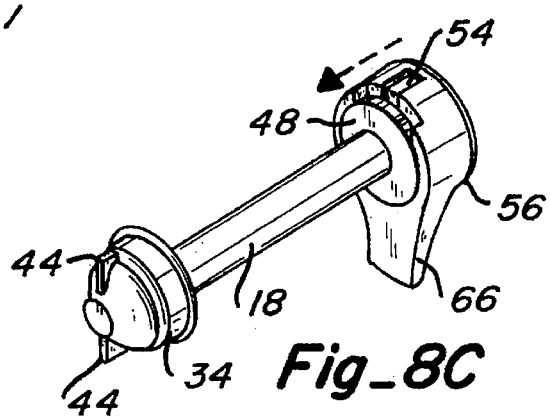
Figure 8A:
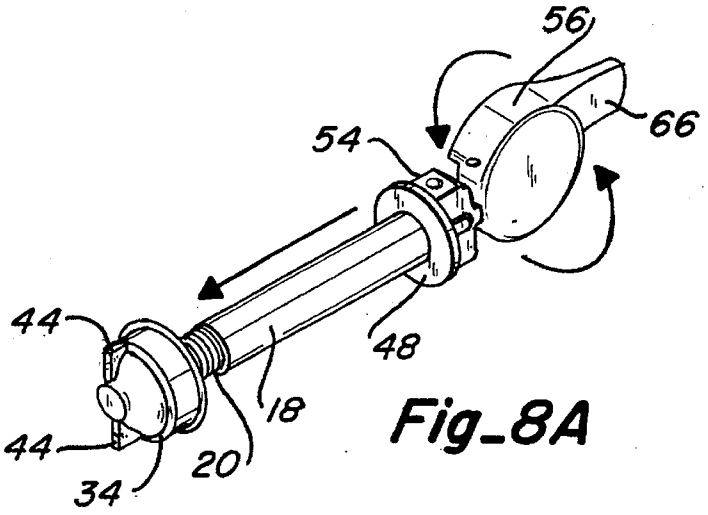

For reassembly with a different wheel, axle 18 is inserted through truck and wheel openings 78 and 80, and nut 34 is made finger tight until cam lever surface 72 contacts stop 48 (FIG. 8A). Actuator/cap 56 is pivoted toward stop 48, and thus truck 12 (FIG. 8B), and then firmly pressed with the fingers or palm of the hand, snapping cam lever 54 down into place and with actuator/cap 56 covering lever 54 (FIG. 8C). Actuator/cap 56 is secured at this position by a tight relative fit of stop/washer 48 within cavity 68 of actuator cap 56.

A second embodiment 110 of the axle assembly of this invention is illustrated in FIG. 9. As may be appreciated, many of the elements heretofore set forth are identical in both assembly and function. However, axle 18 includes a unitarily formed flange 112 at one end thereof in place of the threaded end and nut. Axle 18 is provided with threaded bore 114 at abutment end 26, and end portion 24 of axle 18 includes threaded portion 116 for engagement in bore 114. Thus embodied, axle 18 is inserted through openings 78 and 80. Axle end 24, stop 48, and retainer 52, already assembled, are then attached to axle 18 by inserting and turning threaded end 116 of axle end 24 in bore 114 of axle 18. The remainder of the assembly (and/or dissassembly/reassembly) steps are substantially as heretofore set forth.

As may be appreciated, this invention provides a releasable skate wheel axle assembly that allows a skater to change skate wheels without tools. The assembly is durable, safe and easy to secure for skating.

What is claimed is:

1. A skate wheel axle assembly comprising:

an axle having first and second end portions;

a first retainer at said first end portion of said axle;

a second retainer pivotably connected with said second end portion of said axle and having first surface; and a stop including a center bore slidably maintained on said second end portion of said axle adjacent to said second retainer, said first surface of said second retainer bearing against said stop when said second retainer is pivoted to a securing position.

2. The axle assembly of claim 1 wherein said second retainer has a second surface and is pivotable to a relaxed position with said second surface adjacent to said stop for manipulation of said axle relative to said first retainer.

3. The axle assembly of claim 2 wherein said second retainer has a curved surface portion intermediate said first and second surfaces.

4. The axle assembly of claim 2 wherein said second retainer includes a pivot positioned at said second retainer a first distance from said first surface and a second distance from said second surface, said second distance being less than said first distance.

5. The axle assembly of claim 1 wherein said first retainer has a friction face at a part thereof for inhibiting movement of said first retainer when engaged at said first end portion of said axle and with said face abutting a part of the skate.

6. A releasable axle assembly for skate wheels comprising:

an axle having first and second end portions;

a first retainer at said first end portion of said axle;

a second retainer pivotably connected with said second end portion of said axle;

manipulating means pivotably connected with said second retainer for movement of said second retainer; and wherein either said second retainer or said axle includes a yoke and wherein the other of said second retainer or said axle includes a tongue, said tongue being pivotably retained in said yoke.

7. The axle assembly of claim 6 wherein said manipulating means includes a cap for covering said second retainer when said second retainer is moved to a securing position.

8. The axle assembly of claim 6 wherein said second retainer includes first and second pivot connections spaced on said second retainer from one another, said first pivot connection for pivotable connection of said axle and said second pivot connection for pivotable connection of said manipulating means.

9. The axle assembly of claim 8 wherein said pivot connections of said second retainer are oriented along axes substantially perpendicular to said axle, with said axes of said first and second pivot connections being substantially parallel to each other.

10. The axle assembly of claim 6 wherein said second retainer has first and second adjacent bearing surfaces.

11. The axle assembly of claim 10 further comprising a stop/washer mounted on said second end portion of said axle and against which said bearing surfaces bear during different portions of pivotable movement of said second retainer.

12. The axle assembly of claim 10 wherein said manipulating means is pivotably connected at a position on said second retainer opposite said first bearing surface and adjacent to said second bearing surface.

13. A manually releasable axle assembly for a skate wheel associated with an in-line skate having a truck with openings for receipt therethrough of an axle, said axle assembly comprising:

an axle having first and second end portions and slidably receivable through the openings in the truck, said second end portion having a tongue extending from an abutment;

retainment means at said first end portion of said axle for abutting the truck when said axle is received through the openings in the truck;

a retainer pivotably secured on said second end portion of said axle and being of a size larger than the openings in the truck, said retainer including a camming lever and a lever manipulating cap pivotably connected to one another, said retainer pivotable between a securing position inhibiting axle rotation when said axle is received through the openings in the truck and said nut is engaged at said first end portion of the axle and a relaxed position enabling said axle rotation; and a stop/washer mounted on said tongue of said second end portion of said axle and maintained thereon between said retainer and said abutment.

14. The axle assembly of claim 13 wherein said retainer includes a pivot, a first surface spaced a first distance from said pivot, and a second surface adjacent to said first surface and spaced a second distance from said pivot, said second distance being less than said first distance.

15. The axle assembly of claim 14 wherein said retainer has a curved surface portion intermediate said first and second surfaces, said curved surface portion being spaced from said pivot a distance greater than said first distance.

16. The axle assembly of claim 15 wherein said curved surface portion is defined by a radius and wherein said pivot is located along an axis, said radius and said axis not intersecting.

17. The axle assembly of claim 13 wherein said axle includes an axle body and wherein said second end portion of said axle includes means for engagement to and disengagement from said axle body.

18. The axle assembly of claim 17 wherein said retainment means is a flange unitary with said first end portion of said axle.

* * * * *